United States Patent [19]

Watanabe et al.

[11] Patent Number: 4,892,986

[45] Date of Patent: Jan. 9, 1990

[54] VACUUM CIRCUIT BREAKER

[75] Inventors: Ryuji Watanabe, Toukai; Seiki Shimizu; Hisashi Ando, both of Hitachi, all of Japan

[73] Assignee: Hitachi, Ltd., Tokyo, Japan

[21] Appl. No.: 143,119

[22] Filed: Jan. 12, 1988

Related U.S. Application Data

[63] Continuation of Ser. No. 732,005, Apr. 29, 1985, abandoned.

[30] Foreign Application Priority Data

Feb. 9, 1983 [JP] Japan ..... 58-160448

[51] Int. Cl.[4] ..... H01H 9/30; H01H 33/00; H01H 1/02; H01H 1/06

[52] U.S. Cl. ..... 200/144 B; 200/264; 200/275

[58] Field of Search ..... 200/144 B, 264, 266–269, 200/239, 262, 278, 275, 297; 29/875–880

[56] References Cited

U.S. PATENT DOCUMENTS

| | | | |
|---|---|---|---|
| 2,064,998 | 12/1936 | Waite | 200/264 |
| 3,014,110 | 12/1961 | Cobine | 200/270 |
| 3,226,517 | 12/1965 | Schreiner | 200/266 |
| 3,828,428 | 8/1974 | Wayland | 29/630 |
| 3,864,827 | 2/1975 | Schreiner et al. | 200/264 |
| 3,957,453 | 5/1976 | Hassler et al. | 200/144 B |
| 3,985,512 | 10/1976 | Hassler et al. | 29/182.1 |
| 4,367,382 | 1/1983 | Suzuki et al. | 200/144 B |
| 4,513,186 | 4/1985 | Thomas | 200/144 B |
| 4,546,222 | 10/1985 | Watanabe et al. | 200/144 B |
| 4,547,639 | 10/1985 | Watanabe et al. | 200/144 B |
| 4,551,596 | 11/1985 | Watanabe et al. | 200/144 B |

FOREIGN PATENT DOCUMENTS

| | | | |
|---|---|---|---|
| 216079 | 7/1961 | Austria | 200/266 |
| 761317 | 5/1954 | Fed. Rep. of Germany | 200/262 |
| 138846 | 11/1979 | Fed. Rep. of Germany | 200/144 B |
| 37165 | 4/1974 | Japan | 200/144 B |
| 19766 | 5/1981 | Japan | 200/266 |
| 42734 | 3/1984 | Japan | 200/266 |
| 226564 | 4/1943 | Switzerland | 29/874 |
| 857585 | 1/1961 | United Kingdom | 200/275 |
| 2071421 | 9/1981 | United Kingdom | 200/279 |

*Primary Examiner*—William A. Cuchlinski, Jr.
*Assistant Examiner*—W. Morris Worth
*Attorney, Agent, or Firm*—Antonelli, Terry & Wands

[57] ABSTRACT

An electrode of a vacuum circuit breaker includes a support electrode, an auxiliary support electrode of Co soldered to the support electrode, and an electric contact portion composed of a sintered porous body of Co sintered to the auxiliary support electrode and a conductive alloy impregnating the sintered porous body. The auxiliary support electrode has a protrusion formed with a flange at its end portion. The auxiliary support electrode thus prepared acts to provide a barrier to a solder during the soldering operation, to increase the joining width between the electrical contact portion and the electrode, and to prevent the characteristics of that alloy from being degraded by the soldering operation.

7 Claims, 2 Drawing Sheets

VACUUM CIRCUIT BREAKER

This is a continuation of application Ser. No. 732,005, filed Apr. 29, 1985, now abandoned.

BACKGROUND OF THE INVENTION

The present invention relates to a vacuum circuit breaker and, more particularly, to a vacuum circuit breaker having electrodes in which a contact portion impregnated with an alloy is joined to a conductive support member.

In a vacuum circuit breaker it is desirable to have a small chopping current value and a low surge voltage caused in an electric load by breaking the electric current. In order to obtain the desired operating characteristics, improvements mainly in the materials of the electrodes have been proposed the prior art to propose a variety of electrode materials. More particularly, for example, Japanese Patent Laid-Open No. 5928/1983, proposes an impregnating alloy of Co-Ag-Te or Se, whereby electrodes made of the disclosed alloy have a low surging property (in which the chopping current value is so low that the surge voltage to a load device is low) and has a withstanding excellent voltage characteristic and current breaking capacity. That alloy is prepared by lightly sintering Co powder in advance in a non-oxidizing atmosphere and by vacuum-impregnating the sintered porous product with an alloy of Ag-Te or Ag-Se. An electrode has a high conducting capacity if it is made exclusively of the material thus prepared, because this material has a higher electrical resistance than that of an electrode material composed mainly of copper or silver. Therefore, the material is so joined to a conductive member to form an electrode that it is used only as a contact portion. This joining is performed by a soldering method. A variety of soldering methods have been investigated to determine the manner by which an impregnating alloy having a small concentration of Te or Se can be joined by a general Ag soldering method (i.e., BAg-8 according to the Japanese Industrial Standards). It has been found that the impregnating alloy can hardly be soldered if the concentration of Te or Se exceeds 10 wt. %. This is thought to come from the fact that Te or Se in the impregnating alloy enters the joined layer to make the layer fragile in its entirety. Even if the concentration of Te or Se is lower than the above-specified weight percentage, moreover, there is a tendency that the joining strength becomes weaker than the usual soldering strength. Still moreover, the soldering material has a tendency to diffuse and penetrate into the impregnating alloy thereby raising a problem that the initial composition cannot be maintained to shift the electrode performance. This phenomenon is also caused in case a contact point, in which a porous sintered product of other than Co (e.g., Fe, Ni or Cr) is impregnated with one of alloys of Ag-Pb, Ag-Bi and Ag-Cd. Thus, the contact material prepared by impregnating a sintered product of a refractory metal with the Ag alloy has a problem in the solderability despite it exhibits excellent characteristics as the electrodes of a low-surge vacuum circuit breaker.

An object of the present invention resides in providing a vacuum circuit breaker including electrodes which has a contact portion of a sintered porous body impregnated with an alloy joined firmly to a conductive support portion so that it can withstand a strong peeling force.

According to the present invention, a vacuum circuit breaker which is equipped with a pair of electrodes arranged in a vacuum container to face each other, with each of the electrodes being constructed of a support electrode, an auxiliary support electrode joined to the support electrode, and an electrical contact portion made of a sintered refractory, porous sintered body on the auxiliary support electrode and a conductive metal impregnating said sintered body. The auxiliary support electrode has a protrusion which is shaped to laterally extend at an end thereof and provided on the electrical contact portion side of the auxiliary support electrode.

Preferably, the auxiliary support electrode is joined to the support electrode by the soldering method and is operative to provide a barrier in case of the soldering.

The auxiliary support electrode serves as a barrier against penetration of the impregnating conductive metal into a joining face when soldering is effected, and has the protrusion joined to the porous refractory cobalt body of the electrical contact portion, thereby preventing separation between the auxiliary support electrode and the porous refractory cobalt body at the sintered face and between the electrical contact portion and the support electrode at the joined surface.

Figure 1:
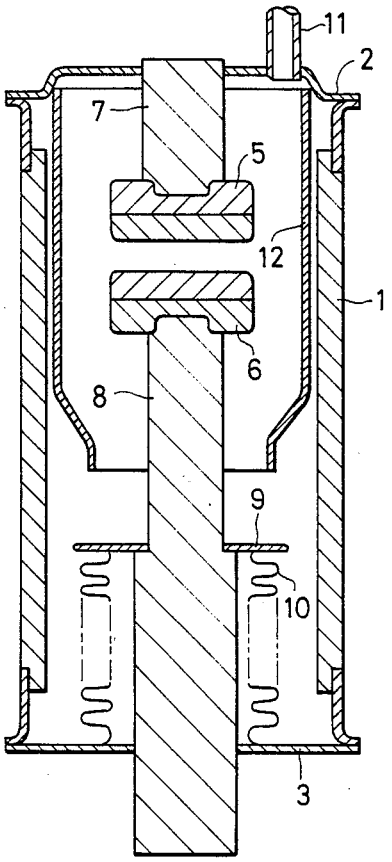
FIG. 1 is a sectional front elevation showing one embodiment of the vacuum circuit breaker according to the present invention.

Referring now to the drawings wherein like reference numerals are used throughout the various views to designate like parts and, more particularly, to FIG. 1, according to this figure a vacuum circuit breaking valve includes an insulating cylinder of ceramics or crystal glass and has respective ends thereof sealed by end plates 2 and 3 of metal to maintain an interior thereof under a high vacuum. A pair of electrodes 5,6 are disposed in the interior of the insulating cylinder, with one electrode 5 being fixed to the end plate 2 by a holder 7 whereas the other is a movable electrode 6 supported axially movably in the end plate 3 by a holder 8. The movable electrode 6 is moved axially by a drive mechanism to turn on and off an electrical circuit. A disk 9 and a bellows 10, mounted on the movable electrode 6 are provided for preventing a loss of the vacuum through a gap between the holder 8 and the end plate 3. The end plate 2 is equipped with an evacuation pipe 11 which leads through a vacuum pump and through which the insulation from being deteriorated by the direct deposition thereon of the electrode-forming substances generated through evaporation and scattering during the circuit breaking operation.

Figure 2:
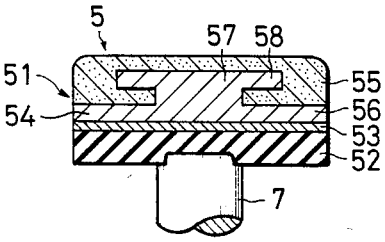
FIG. 2 is a sectional view showing an electrode adopted in the vacuum circuit breaker of FIG. 1.

As shown in FIG. 2, the electrode 5 is composed of a compound alloy contact 51 and a support electrode 52 fixedly soldered to the holder 7 by a silver solder 53. The contact 51 is made of an alloy forming an auxiliary support electrode 54 and an electrical contact portion 55. The auxiliary support electrode 54 is formed into a pulley shape and includes a base 56 and a protrusion 57 protruding therefrom into the electrical contact portion 55. The protrusion is formed at its end portion with a flange 58 which has a smaller external diameter than that of the base 56. The electrical contact portion 55 is molded around the protrusion 57 of the auxiliary support electrode 54 and is prepared by sintering a sintered porous body of a conductive, refractory material around the protrusion of the auxiliary support electrode 54 and by impregnating the sintered porous body with an impregnating alloy. The material used to make the electrical contact portion 55 of the contact 51 has excellent characteristics as a low-surge vacuum breaker. Moreover, the auxiliary support electrode 54, functions as a barrier for preventing the solder 53 from entering into the electrical contact portion 55 at the base 56 and is shaped such that the electrical contact portion 55 can be firmly joined to the auxiliary support electrode 54. In other words, the shape is determined to establish a shearing force in the flange and in a portion of the electrical contact portion 55 opposed to the former, when a separating axial force is exerted upon the electrical contact portion 55. The joining force of the electrical contact portion 55 and the auxiliary support electrode 54 includes mainly not only the local sintering force between the sintered porous body and the auxiliary support electrode 54 and the adhering force with the material impregnating the sintered body but also the shearing force. The electrical contact portion 55, thus strongly joined to the auxiliary support electrode, is strongly to the support electrode 52 through that auxiliary support electrode 54. The electrode 6 has the same construction as that of the electrode 5. As a result, these electrodes 5 and 6 are protected from separation and slackness of the electrical contact portion 55 even if they are subjected to a strong thermal shock.

Preferably, the support electrode 52 is made of pure copper; the auxiliary support electrode 54 is made of cobalt and the alloy of the electrical contact portion is a compound (of 50% Co-50% $Ag_2Se$) which is prepared by impregnating the sintered porous body of cobalt with a silver alloy containing 10% or more of Se or Te, e.g., by impregnating the sintered body of 50% Co with 50% $Ag_2Se$.

The cobalt is the most excellent material for the electrodes of the vacuum breaker because it has a high conductivity, a high arc breaking characteristic and a liability to be impregnated with the Ag alloy (or an excellent wettability). In this embodiment, cobalt is used for making the sintered body of the electrical contact portion 55 and the auxiliary support electrode 54.

The electrodes of the present invention can be applied for a rated voltage of 3 to 73 KV and a breaking current of 8 to 60 KA, and, for example, the electrodes of FIG. 2 is a vacuum breaker having a breaking current of 8 KA at a voltage of 7.2 KV.

Figure 3:
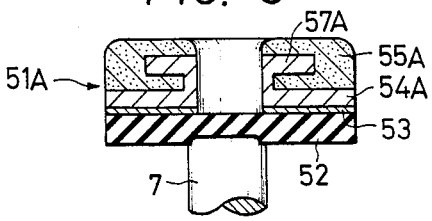
FIG. 3 is a sectional view showing an electrode of the vacuum circuit breaker according to another embodiment of the present invention.
Figure 4:
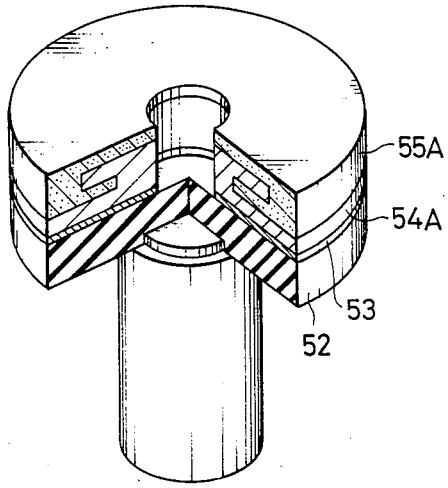
FIG. 4 is a partially cut-away sectional view of FIG. 3.

The electrode of FIGS. 3 and 4 is the same as the electrode of FIG. 2 except that a contact 51A is formed into a ring shape. An auxiliary support electrode 54A is made of a sintered Co plate and is ring-shaped to have a through hole 59 which is formed at the center of a flanged protrusion 57A. This ring-shaped auxiliary support electrode 54A is prepared by impregnating a sintered body of Co powder at the side of the protrusion 57A with an alloy of $Ag_2Se$ to form an electrical contact portion 55A. This contact 51A is soldered to the support electrode 52 by the Ag solder 53. One preferred example of using the electrodes thus prepared is a vacuum breaker having a rated voltage of 7.2 KV and a breaking current of 12.5 KA.

Figure 5:
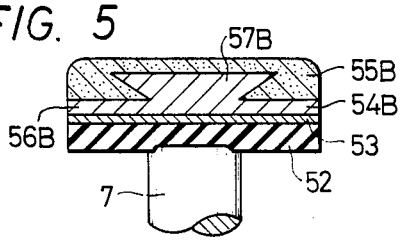
FIGS. 5, 6, 7, 8 and 9 are sectional views showing electrodes for the vacuum circuit breaker according to other embodiments of the present invention, respectively.

In FIG. 5, an auxiliary support electrode 54B has a protrusion 57B which protrudes from a base 56B and which has a conical shape whose diameter decreases in the direction toward the base 56B. On this auxiliary support electrode 54B, there is formed a sintered Co body which is impregnated with an alloy such as $Ag_2Se$ to form an electrical contact portion 55B. The contact thus prepared is soldered to the support electrode 52 by the silver solder 53.

Figure 6:
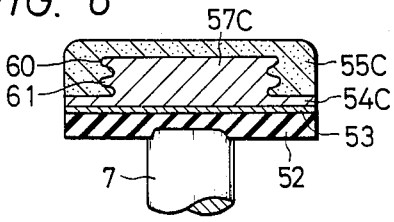

In FIG. 6, an auxiliary support electrode 54C has a protrusion 57C formed with two flanges 60 and 61. Moreover, an electrical contact portion 55C is formed to surround that protrusion 57C. The remaining construction is the same as that of the embodiment of FIG. 5.

Figure 7:
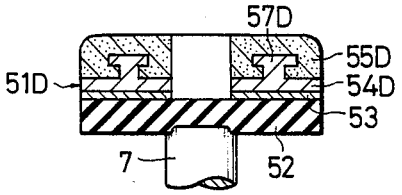

In FIG. 7, an auxiliary support electrode 54D is made of a sintered Co body and is constructed of a ring-shaped base and a flanged annular protrusion 57D protruding from the vicinity of the widthwise center of the ring-shaped base. As with the above described embodiments, the auxiliary support electrode 54D is joined to a sintered porous body of Co which is impregnated with the alloy $Ag_2Se$ to form an electrical contact portion 55D. The contact 51D thus prepared is soldered to the support electrode by the silver solder 53. The electrodes thus prepared can withstand a strong thermal shock and can find a suitable application in a vacuum breaker having a rated voltage of 7.2 KV and a breaking current of 20 KA.

Figure 8:
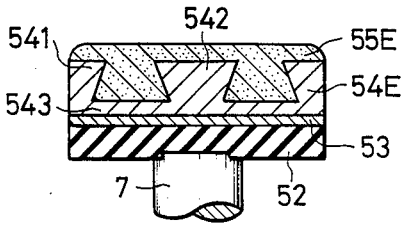

In FIG. 8, an auxiliary support electrode 54E is made of a sintered Co body and is formed with two protrusions 541 and 542. The protrusion 541 is formed into such a cylindrical shape as to have its internal diameter decreased apart from a base 543 whereas the protrusion 542 is formed into such a column shape as to have its external diameter increased apart from the base 543. The sintered Co body is joined to the auxiliary support electrode 54E and is impregnated with $Ag_2Se$ to form an electrical contact portion 55E. This contact is soldered to the support electrode 52 by the silver solder 53.

Figure 9:
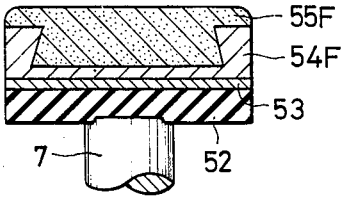

The embodiment of the electrode of FIG. 9 same as that of FIG. 8 except that an auxiliary support electrode 54F has no central protrusion.

The auxiliary support electrode of the above-specified kind is preferably made of a densely sintered body but may be made of a molten material.

Moreover, one example of the material for the aforementioned electrical contact portion is enumerated in the following (in wt. %):

50% Co-50% $Ag_2Se$;
50% Co-50% $Ag_2Te$;
60% W-40% $Ag_2Se$;
60% W-40% $Ag_2Te$;
60% WC-40% $Ag_2Te$;
60% TaC-40% $Ag_2Te$;
40% Co-50% Ag-10% Te;
40% Co-50% Ag-10% Se;
40% Fe-50% Ag-10% Te;
40% Fe-50% Ag-5% Te-5% Se.

EXAMPLE 1

Co powder having a particle size of 10 microns or less was press-molded and then vacuum-sintered. The resultant sintered Co disk (of a diameter of 40 mm and a thickness of 5 mm) having a theoretical density ratio of 95% or more was cut into a pulley-shaped Co plate which had such a small flange at its one end as is indicated at reference numeral 54 in FIG. 2. This Co plate, i.e., the auxiliary support electrode 54 was placed on the bottom of a crucible of graphite having a diameter of 41 mm. Co powder of −200 to +325 mesh was deposited, while being vibrated, to a height of about 5 mm on that auxiliary support electrode 54 and was covered with a cover of graphite. The crucible was heated at 900° C. for one hour in a hydrogen atmosphere. After this, the auxiliary support electrode was subjected to degasification at 1,000° C. for three hours in a high vacuum. When this temporarity sintered body was then taken out from the graphite crucible, there was prepared a composite sintered body in which the auxiliary support electrode 54 of the Co plate providing a barrier for the soldering operation and the temporarily sintered porous layer of the Co powder were integrated. Next, the composite sintered body thus prepared was impregnated at a temperature 920° to 979° C. in a vacuum with an alloy of Ag and Se (which was a molten alloy composed mainly of the compound of $Ag_2Se$ at 950° to 1,000° C. in the present example), which had been prepared in advance by a melting method. As a result, it was confirmed that the composite sintered body had its upper porous powder layer impregnated with the Ag-Se alloy, its lower protruded Co plate left completely as it had been, and its inside cleared of Ag and Se. It was also found in view of the microstructure of the impregnated contact that the impregnation arrived as deep as the recess of the pulley-shaped Co plate or that the interfaces between the Co plate and the Co powder were freed from any unimpregnation or the so-called "defect".

Figure 10:
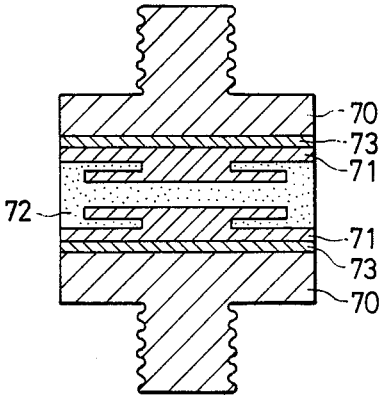
FIGS. 10 and 11 are sectional views showing a testing electrode and a comparison electrode as to the present invention, respectively.
Figure 11:
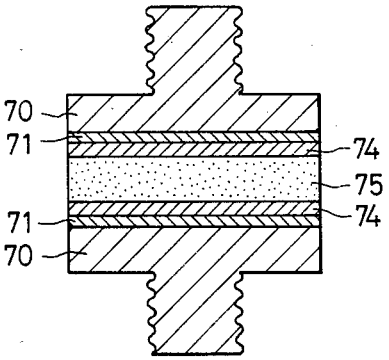

Next, the impregnated alloy contact was machined to a predetermined size and was soldered in an evacuated furnace at a temperature of 800° to 850° C. by sandwiching the Ag solder 53, as shown in FIG. 2. In the present example, the aforementioned solderability was excellent because the Ag soldering was conducted between the pure Co and Cu. In order to examine the soldered joining strength, the tensile strengths were compared by the structures shown in FIGS. 10 and 11 between a laminated type structure (as shown in FIG. 11) for simplifying the comparison and the joined structure (as shown in FIG. 10) of the present invention. In FIG. 10, there is shown a test piece of the electrode in which a contact constructed of an auxiliary support electrode 71 and an electrical contact member 72 of an alloy of Co-$Ag_2Se$ joined to the support electrode 71 by the sintering and impregnation was joined to a support electrode 70 by the Ag solder. FIG. 11 shows a test piece for comparison, which had auxiliary support electrodes 74 made of flat plates joined between an electrical contact member by the sintering and impregnation and in which the remaining conditions were the same as those of FIG. 10. As tabulated, the tensile strength of the present invention was about 2.5 times as high as that of the test piece. Moreover, it was confirmed that the laminated type piece for comparison was broken at the joining interface between the Co plate and the impregnated layer and that the joined structure of the present invention was broken at the impregnated layer itself, i.e., at the so-called "matrix". In other words, it can be said that the adhering strength of the Co plate and the joining strength of the solder were higher than that of the contact itself. It was also found in view of the appearance after the tensile strength that defects such as separations or cracks were few in the adhering interface between the Co plate and the impregnated layer.

A number of electrical performance tests and length of service life as a result of continuously turning on and off a load were tested by assembling a contact having the joining structure shown in FIG. 2 and having a diameter of 40 mm, in the vacuum valves having rated voltages of 7.2 KV and 12.5 KV. As a result, the rated voltage short-circuit current breaking performances were sufficiently satisfied, and the low-surge characteristics featuring the aforementioned contact material were verified. Moreover, it was confirmed that the electrode joining characteristics contemplated by the present invention were excellent and that no problem arises even after the switching tests of totally 10,000 times such that the contact was free from being separated and coming out.

TABLE

| Type | Joining Structure | Tensile Strength ($kg/mm^2$) | Broken Position |
|---|---|---|---|
| FIG. 11 | Laminated Type | 2.6 $kg/mm^2$ | Separation |
| FIG. 10 | Buried Protrusion | 6.6 $kg/mm^2$ | Broken Contact |

EXAMPLE 2

By a method similar to that of the Example 1, a number of examining tests were conducted with the vacuum valve having the electrode joining structure in which the auxiliary support electrode 54B of the Co plate formed with the protrusion having a section diverging, as shown in FIG. 5, was used and impregnated with the Ag alloy composed mainly of the $Ag_2Se$. The test results confirmed that both the various electrical performances and joining characteristics were excellent like those of the Example 1.

EXAMPLE 3

As with Example 1, the Fe, Ni and Cr plates having pulley-shaped protrusions were deposited with the respective powders of Fe, Ni and Cr in identical or different kinds of combinations and were sintered into an integral structure in an atmosphere of hydrogen gas. A variety of tests were conducted by assembling into a vacuum valve the electrode having a joining structure similar to that of the Example 1, which had the contact prepared by impregnating those respective sintered composite bodies with an alloy of Ag-5Pb or Ag-5Bi. As a result, the electrical performances and joining characteristics obtained were excellent.

EXAMPLE 4

As with Example 1, W and WC plates having pulley-shaped protrusions were deposited with powders of W and WC, respectively, and were sintered into an integral structure in a vacuum but at a higher temperature than the temperature in Example 3. The tests were conducted by assembling into a variety of vacuum valves the electrodes having joining structures similar to that of the Example 1, which had the respective contacts prepared by impregnating those respective composite sintered bodies with alloys of Ag-10Te and Ag-37Te. Other tests were also conducted by preparing the electrodes which contained electrical contact member of 60% W-40% $Ag_2Se$, 60% W-40% $Ag_2Te$ or 60% WC-40% $Ag_2Te$ by impregnating the aforementioned composite sintered bodies with $Ag_2Se$ and $Ag_2Te$. As a result, the electrical performances and joining characteristics obtained were excellent.

According to the joining structure of the present invention, as has been described hereinbefore, the composite metal contact exemplified as that for the low-surge type vacuum breaker and containing the impregnating alloy can be joined firmly to the support electrode. Moreover, the joining structure of the present invention can have effects to prevent the solder or the like from diffusing or stealing into the impregnating contact during the joining operation and to maintain the intrinsic contact performances.

What is claimed is:

1. A vacuum circuit breaker comprising:

a vacuum container;

a pair of copper support electrodes axially arranged in and carried by said vacuum container, at least one of said support electrodes being axially movable;

a pair of auxiliary support electrodes, each made of a sintered conductive refractory cobalt body of a theoretical density ratio of more than 95% and having a disk-like base and a protrusion projecting therefrom, said protrusion having a larger diameter portion at an end thereof and a smaller diameter portion between said base and said larger diameter portion, said larger diameter portion being smaller than an outer diameter of said base;

a pair of porous conductive cobalt refractory bodies respectively sintered on said auxiliary support electrodes so as to embed said protrusion, the sintered porous conductive cobalt refractory bodies each having sufficient porosity for impregnation by a molten metal compound and impregnated with a melted metal compound of $Ag_2Se$ which reaches interfaces between said auxiliary support electrodes and said sintered porous cobalt refractory bodies thereby providing a pair of electrical contacts, with each of said contacts providing at one side an auxiliary support electrode portion and at an opposite side of electrical contact portion; said porous refractory body sintered on said auxiliary support electrode having a diameter substantially equal to diameters of said base of said auxiliary support electrode and said support electrode and solder layers of silver alloy each disposed between and joining one end of said support electrode and said auxiliary support electrode and spreading substantially all over an opposite face of said auxiliary support electrode to said end of said support electrode.

2. A vacuum circuit breaker comprising:

a vacuum container;

a pair of support electrodes axially arranged in and carried by said vacuum container, at least one of said support electrodes being axially movable;

a pair of auxiliary support electrodes each made of a sintered cobalt disc with a theoretical density ratio of more than 95%, having a through hole in an axial direction thereof and consisting of a hollow disc-like base and a hollow protrusion projecting therefrom, said hollow protrusion including a flange portion having a diameter less than a diameter of said base at an end thereof and a similar diameter portion between said base and said flange portion such that an axial length of an inner peripheral surface defined by the hollow base and protrusion is longer than an axial length of an outer peripheral surface of said base;

a pair of porous cobalt bodies respectively having through holes in axial directions thereof and sintered on said auxiliary support electrodes so as to embed said protrusion and so that said through holes of said cobalt bodies respectively align with ones of said cobalt discs, said pair of porous cobalt bodies each being impregnated with a melted metal compound of $Ag_2Se$ which also reaches interfaces between said auxiliary support electrodes and said sintered porous cobalt bodies, thereby providing a pair of electrical contacts, with each of said contacts providing at one side an auxiliary support electrode portion and at an opposite side an electrical contact portion, said porous refractory body sintered on said auxiliary support electrode having a diameter substantially equal to diameters of said base of said auxiliary support electrode and said support electrode; and solder layers of silver alloys each disposed between and joining one end of said support electrode and said auxiliary support electrode portion and spreading substantially all over an opposite surface of said auxiliary support electrode to said end of said support electrode.

3. A vacuum circuit breaker as defined in claim 2, wherein said through holes formed in said each cobalt disc and said each cobalt body define a cylindrical surface extending axially, said cylindrical surface being substantially coaxial to an outer cylindrical surface of said electrical contact.

4. A vacuum circuit breaker comprising:

a vacuum container;

a pair of support electrodes of copper axially arranged in and carried by said vacuum container, at least one of said support electrodes being axially movable;

a pair of auxiliary support electrodes each made of a sintered cobalt disc with a theoretical density ratio of more than 95% and consisting of a ring-like base having a through hole at a central portion thereof and a flanged annular protrusion projecting from said base, said protrusion including, at an end thereof, a ring-shaped flange portion expanding outward and inward in a perpendicular direction to a protruding direction so as to have an outer diameter less than an outer diameter of said base and an inner diameter larger than said through hole of said base;

a pair of porous cobalt bodies respectively sintered on said auxiliary support electrode so as to embed said protrusions and being impregnated with a melted metal compound of $Ag_2Se$ which also reaches interfaces between said auxiliary support electrodes and said sintered porous cobalt bodies, said pair of porous cobalt bodies each having a through hole having substantially the same inner diameter as said through hole of said cobalt disc, thereby providing a pair of electrical contacts, with each of said contacts providing at one side an auxiliary support electrode portion and at an opposite side an electrical contact portion, said porous refractory body sintered on said auxiliary support electrode having a diameter substantially equal to diameters of said base of said auxiliary support electrode and of said support electrode; and solder layers of silver alloy each disposed between and joining one end of said support electrode and said auxiliary support electrode portion and spreading substantially all over an opposite surface of said auxiliary support electrode to said end of said support electrode.

5. A vacuum circuit breaker comprising:

a vacuum container;

a pair of support electrodes of copper axially arranged in and carried by said vacuum container, at least one of said support electrodes being axially movable;

a pair of auxiliary support electrodes, each made of a conductive sintered refractory cobalt with a theoretical density ratio of more than 95% and having a base and a protrusion projecting therefrom, said protrusion having a larger diameter portion at an end thereof and a smaller diameter portion between said base and said larger diameter portion, said larger diameter portion being smaller than an outer diameter of said base;

a pair of porous conductive cobalt refractory bodies respectively sintered on said auxiliary support electrodes so as to embed said protrusion and impregnated with a melted metal compound of $Ag_2Te$ which also reaches interfaces between said auxiliary support electrodes and said sintered porous cobalt bodies, thereby providing a pair of electrical contacts, with each of said contacts providing at one side an auxiliary support electrode portion and at an opposite side an electrical contact portion, said porous refractory body sintered on said auxiliary support electrode having a diameter substantially equal to diameters of said base of said auxiliary support electrode and of said support electrode; and solder layers of silver alloy each disposed between and joining one end of said support electrode and said auxiliary support electrode and spreading substantially all over an opposite surface of said auxiliary support electrode to said end of said support electrode.

6. A vacuum circuit breaker comprising:

a vacuum container;

a pair of support electrodes of copper axially arranged in and carried by said vacuum container, at least one of said support electrodes being axially movable;

a pair of auxiliary support electrodes each made of a sintered cobalt disc with a theoretical density ratio of more than 95% having a through hole in an axial direction thereof and consisting of a hollow disc-like base and a hollow protrusion projecting therefrom, said hollow protrusion including a flange portion having a diameter less than a diameter of said base at an end thereof and a smaller diameter portion between said base and said flange portion such that an axial length of an inner peripheral surface defined by the hollow base and protrusions is longer than an axial length of an outer peripheral surface;

a pair of porous cobalt bodies respectively having through holes in axial directions thereof and sintered on said auxiliary support electrodes so as to embed said protrusion and so that said through holes of said cobalt bodies respectively align with ones of said cobalt discs, said pair of porous cobalt bodies each being impregnated with a melted metal compound, a compound of $Ag_2Te$ which also reaches interfaces between said auxiliary support electrodes and said sintered porous cobalt bodies, thereby providing a pair of electrical contacts, with each of said contacts providing at one side an auxiliary support electrode portion and at an opposite side an electrical contact portion, said porous refractory body sintered on said auxiliary support electrode having a diameter substantially equal to diameters of said base of said auxiliary support electrode and of said support electrode; and solder layers of silver alloy each disposed between and joining one end of said support electrode and said auxiliary support electrode portion and spreading substantially all over an opposite surface of said auxiliary support electrode to said end of said support electrode.

7. A vacuum circuit breaker comprising:

a vacuum container;

a pair of support electrodes of copper axially arranged in and carried by said vacuum container, at least one of said support electrodes being axially movable;

a pair of auxiliary support electrodes each made of a sintered cobalt disc with a theoretical density ratio of more than 95% and consisting of a ring-like base having a through hole at a central portion thereof and a flanged annular protrusion projecting from said base, said protrusion including, at an end thereof, a ring-shaped flange portion expanding outward and inward in a perpendicular direction to a protruding direction so as to have an outer diameter less than an outer diameter of said base and an inner diameter larger than said through hole of said base;

a pair of porous cobalt bodies respectively sintered on said auxiliary support electrode so as to embed said protrusions and being impregnated with a melted metal compound of $Ag_2Te$ which also reaches interfaces between said auxiliary support electrodes and said sintered porous cobalt bodies, said pair of porous cobalt bodies each having a through holes having substantially the same inner diameter as said through hole of said cobalt disc, thereby providing a pair of electrical contacts, with each of said contacts providing at one side an auxiliary support electrode portion and at an opposite side an electrical contact portion, said porous refractory body sintered on said auxiliary support electrode having a diameter substantially equal to diameters of said base of said auxiliary support electrode and of said support electrode; and solder layers of silver alloy each disposed between and joining one end of said support electrode and said auxiliary support electrode portion and spreading substantially all over an opposite surface of said auxiliary support electrode to said end of said support electrode.

* * * * *